US012215442B2

(12) United States Patent
Amaral et al.

(10) Patent No.: US 12,215,442 B2
(45) Date of Patent: Feb. 4, 2025

(54) FLAME RESISTANT FABRIC COMPRISING A PTW FIBER BLEND

(71) Applicant: PTW HOLDINGS, LLC, El Paso, TX (US)

(72) Inventors: Paul Amaral, Watertown, CT (US); David Ronner, Berkeley Heights, NJ (US)

(73) Assignee: PTW HOLDINGS, LLC, El Paso, TX (US)

( * ) Notice: Subject to any disclaimer, the term of this patent is extended or adjusted under 35 U.S.C. 154(b) by 0 days.

(21) Appl. No.: 17/708,592

(22) Filed: Mar. 30, 2022

(65) Prior Publication Data

US 2023/0313422 A1 Oct. 5, 2023

(51) Int. Cl.
*D02G 3/04* (2006.01)
*D02G 3/44* (2006.01)

(52) U.S. Cl.
CPC ..... *D02G 3/047* (2013.01); *D02G 3/441* (2013.01); *D02G 3/443* (2013.01); *D10B 2331/021* (2013.01)

(58) Field of Classification Search
CPC ..... D02G 3/443; D02G 3/441; D02G 3/047; D03D 15/47; D03D 15/513
See application file for complete search history.

(56) References Cited

U.S. PATENT DOCUMENTS

| | | | | |
|---|---|---|---|---|
| 9,034,777 | B2 | 5/2015 | Hines et al. | |
| 9,745,674 | B2 | 8/2017 | Hines et al. | |
| 10,030,326 | B2 | 7/2018 | Hines, Jr. et al. | |
| 10,774,451 | B2 | 9/2020 | Stanhope et al. | |
| 11,662,180 | B1 | 5/2023 | Emery et al. | |
| 2006/0292953 | A1 | 12/2006 | Ashley et al. | |
| 2011/0177740 | A1* | 7/2011 | Waxman | D02G 3/443 442/302 |
| 2011/0250810 | A1* | 10/2011 | Zhu | D02G 3/443 524/35 |
| 2012/0146784 | A1 | 6/2012 | Hines et al. | |
| 2013/0045653 | A1* | 2/2013 | Takahashi | D03D 15/513 428/221 |
| 2014/0187113 | A1* | 7/2014 | Hines, Jr. | D04H 1/43835 428/221 |
| 2014/0208491 | A1* | 7/2014 | Schmitt | D02G 3/443 57/208 |
| 2015/0159304 | A1 | 6/2015 | Schmitt et al. | |
| 2017/0175302 | A1 | 6/2017 | Habicht et al. | |
| 2021/0164133 | A1 | 6/2021 | Adams et al. | |

FOREIGN PATENT DOCUMENTS

| | | | |
|---|---|---|---|
| WO | 2008027454 | A1 | 3/2008 |
| WO | 2014018697 | A1 | 1/2014 |
| WO | 2015171990 | A1 | 11/2015 |
| WO | 2021178512 | A1 | 9/2021 |

OTHER PUBLICATIONS

International Search Report from corresponding PCT/US2023/016539 mailed Jul. 11, 2023.

Olsen. Methods for Evaluating Thermal Camouflage. Paper presented at the RTO SCI Symposium on "Sensors and Sensor Denial by Camouflage, Concealment and Deception" held in Brussels, Belgium, Apr. 19-20, 2004, and published in RTO-MP-SCI-145.

* cited by examiner

*Primary Examiner* — Larissa Rowe Emrich
(74) *Attorney, Agent, or Firm* — Caesar Rivise, PC

(57) ABSTRACT

A yarn is disclosed, which includes a blend of: 33-75 wt. % of a flame resistant fiber having a limit of oxygen index of 43%, a thermal conductivity of 0.0063 watt/meter/K and a moisture regain of 12%; 10-40 wt. % of an aramid fiber; and up to 36% of a wearability enhancing fiber selected from the group consisting of wool, flame resistant rayon and lyocell, wherein the yarn is free of thermoplastics and is sufficiently flame resistant such that a fabric consisting of the yarn is effective to limit a body burn percentage resulting from 4 seconds of flame exposure to less than 35% as measured by ASTM F1930. Fabrics and garments including the inventive yarn are also disclosed.

9 Claims, No Drawings

FLAME RESISTANT FABRIC COMPRISING A PTW FIBER BLEND

BACKGROUND OF THE INVENTION

1. Field of Invention

This invention relates to flame resistant yarns, fabrics and garments, and particularly to fiber blends having flame resistance properties.

2. Description of Related Art

Flame resistant (FR) fabrics are fabrics which tend not to sustain a flame when the source of ignition is removed. FR fabrics are used in a variety of materials where exposure to flames, electrical arcs and/or molten metal is a significant possibility. Thus, FR fabrics are typical components of garments worn by, e.g., fire fighters, electrical utility workers and steel workers.

US 20120146784 A1 discloses protective fabrics and garments particularly suitable for use by electrical utility workers who are exposed to the risk of electrical arc flash hazards.

US 20140187113 A1 discloses fiber blends useful for producing garments particularly useful for occupations requiring high thermal properties, such as oil and gas workers, fire fighters, utility workers, and military personnel. The blends can further comprise structural fibers, such as aramid, melamine, nylon, structural carbon, and/or polyacrylonitrile fibers, and comfort fibers, such as cotton, cellulose, lyocell, cellulose derivatives and/or wool fibers. The garments are said to be flame resistant without compromising comfort of the wearers by maintaining breathability and moisture management properties of the fabric.

U.S. Pat. No. 9,034,777 B2 discloses woven FR fabrics and garments that are particularly useful in denim work clothes because they are comfortable to wear and exhibit fire resistance and abrasion resistance.

US 20150159304 A1 discloses FR fabrics and garments comprising polyacrylate fibers blended with companion fibers to provide increased strength and other desired properties.

U.S. Pat. No. 9,745,674 B2 discloses spun yarns, fabrics, and garments with a balance of high thermal and comfort properties. The spun yarns comprise an intimate blend of fibers including flame resistant fiber, hydrophilic fibers, and anti-static fibers.

U.S. Pat. No. 10,030,326 B2 discloses lightweight fabrics with a balance of high thermal properties, especially arc resistance and flash fire resistance, on the one hand, and durability and comfort properties, on the other hand. The lightweight fabrics are said to be particularly useful in garments for utility workers, industrial workers, military personnel, and firefighters.

U.S. Pat. No. 10,774,451 B2 discloses FR fabrics comprising first yarns including inherently flame resistant fibers and second yarns including wool fibers. The fabrics are said to be particularly suitable for cold weather clothing for workers who may be exposed to flash fires, other thermal exposures, and arcs in the course of performing their jobs.

US 20210164133 A1 discloses FR fabrics that have improved comfort, and that, in some embodiments, are less expensive than other fabrics formed with inherently flame resistant fibers. Improved comfort and lower cost can be achieved by predominantly locating the inherently flame resistant fibers on the front face of the fabric to impart the requisite thermal and arc protection and predominantly locating the more comfortable (and less expensive) fibers on the back face of the fabric positioned next to the wearer.

A particularly critical use of FR fabrics is in the manufacture of military uniforms such as the FRACU (Flame Retardant Active Combat Uniform or (Flame Resistant Advanced Combat Uniform). Recent studies of injuries to military personnel suggests that current FRACU garments do not adequately protect military personnel from injury.

WO 2021178512 A1 discloses FR yarns comprising a blend of FR fibers and non-FR fibers having additional desired properties. The yarns provide fabrics that are said to address the goals of the U.S. military to develop fabrics that are substantially fire resistant or non-flammable, but which also have a good abrasion resistance, are comfortable and printable, and which are economical for use in both combat and non-combat situations.

Despite the foregoing developments, it is still desired to provide further improved FR fabrics and garments.

It is further desired to provide an FR fabric that can be used to construct garments that meet or exceed the performance requirements stated in the following specifications Cloth Flame Resistant GL-PD-07-12, 3 May 2016, Type III and V, Class III, and Cloth Plain and Basket Weave, Aramid GL-PD-10-13A, 2 Sep. 2015, Type II, Class 11.

It is still further desired to provide an FR fabric that reduces the potential of bodily harm suffered by the wearer of a garment comprising the FR fabric.

It is still further desired to provide an FR fabric with an extended garment life cycle by increasing the wet and dry fabric strengths.

It is still further desired to provide an FR fabric that will improve wearer comfort by improving the moisture management of the fabric.

All references cited herein are incorporated herein by reference in their entireties.

BRIEF SUMMARY OF THE INVENTION

Accordingly, a first aspect of the invention is a yarn comprising a blend of: 33-75 wt. % of a flame resistant fiber having a limit of oxygen index of 43%, a thermal conductivity of 0.0063 watt/meter/K and a moisture regain of 12%; 10-40 wt. % of an aramid fiber; and up to 36% of a wearability enhancing fiber selected from the group consisting of wool, flame resistant rayon and lyocell, wherein the yarn is free of thermoplastics and is sufficiently flame resistant such that a fabric consisting of the yarn is effective to limit a body burn percentage resulting from 4 seconds of flame exposure to less than 35% as measured by ASTM F1930.

In certain embodiments, the yarn is sufficiently flame resistant such that the fabric consisting of the yarn is effective to limit the body burn percentage resulting from 4 seconds of flame exposure to less than 15% as measured by ASTM F1930.

In certain embodiments of the yarn, the flame resistant fiber is PYROTEX.

In certain embodiments of the yarn, the aramid fiber is a para-aramid fiber and the wearability enhancing fiber is wool.

In certain embodiments, the yarn comprises 49-51 wt. % of the flame resistant fiber, 29-31 wt. % of the aramid fiber and 19-21 wt. % of the wearability enhancing fiber.

In certain embodiments of the yarn, the para-aramid fiber is TWARON or KEVLAR

In certain embodiments, the yarn is free of cellulosic fibers.

In certain embodiments, the yarn further comprises an electrostatic dissipative fiber.

A second aspect of the invention is a fabric comprising the inventive yarn, which is effective to limit the body burn percentage resulting from 4 seconds of flame exposure to less than 35% as measured by ASTM F1930.

A third aspect of the invention is a garment comprising the inventive yarn, which is effective to limit the body burn percentage resulting from 4 seconds of flame exposure to less than 35% as measured by ASTM F1930.

A fourth aspect of the invention is a fabric comprising a blend of: 33-75 wt. % of a flame resistant fiber having a limit of oxygen index of 43%, a thermal conductivity of 0.0063 watt/meter/K and a moisture regain of 12%; 10-40 wt. % of an aramid fiber; and up to 36% of a wearability enhancing fiber selected from the group consisting of wool, flame resistant rayon and lyocell, wherein the fabric is free of thermoplastics and is effective to limit a body burn percentage resulting from 4 seconds of flame exposure to less than 35% as measured by ASTM F1930.

In certain embodiments, the fabric is effective to limit the body burn percentage resulting from 4 seconds of flame exposure to less than 13% as measured by ASTM F1930.

In certain embodiments of the fabric, the flame resistant fiber is PYROTEX.

In certain embodiments of the fabric, the aramid fiber is a para-aramid fiber and the wearability enhancing fiber is wool.

In certain embodiments, the fabric comprises 49-51 wt. % of the flame resistant fiber, 29-31 wt. % of the aramid fiber and 19-21 wt. % of the wearability enhancing fiber.

In certain embodiments of the fabric, the para-aramid fiber is TWARON or KEVLAR.

In certain embodiments, the fabric is free of cellulosic fibers.

In certain embodiments, the fabric further comprises an electrostatic dissipative fiber.

DETAILED DESCRIPTION OF PREFERRED EMBODIMENTS OF THE INVENTION

Glossary

As used herein, a "yarn" is a continuous strand of at least one type of fiber.

As used herein, a "fabric" is an interlaced network of at least one type of yarn.

As used herein, a "blend" is a fabric or yarn comprising more than one type of fiber. An "intimate blend" refers to a statistically random mixture of staple fiber components in a yarn.

As used herein, "garment" refers to any article of clothing or clothing accessory comprising a fabric and intended to be worn by a human or animal, including but not limited to shirts, pants, dresses, skirts, underwear, socks, coats, jackets, vests, wraps, outerwear, footwear, headwear, swimwear, belts, gloves, headbands, collars and wristbands.

As used herein, "flame resistant" and "flame resistance" refer to the property of a material wherein the material will not sustain a flame when the source of ignition is removed from the material. The expressions are used herein synonymously with the expressions "fire resistant", "flame retardant" and "fire retardant".

Fiber Blends

The fabric of the invention comprises at least one yarn comprising a blend of staple fibers. The yarn comprises an FR fiber and at least one of a durability enhancing fiber and a wearability enhancing fiber. Most preferably, the yarn comprises all three of these different types of fibers. Most preferably, the yarn comprises a fiber blend of PYROTEX, TWARON and wool (sometimes referred to herein as a "PTW" fiber blend). When static dissipation is an expressed concern, an anti-static fiber may be added to the blend. The anti-static fiber, when included in the blend, is preferably provided in an amount of 3 to 5% of the total blend weight.

The FR fiber is preferably an acrylic fiber or a modacrylic fiber, which is an acrylic fiber made from a polymer comprising residues of acrylonitrile modified with the residues of other monomers, such as vinyl monomers and halogen-containing vinyl monomers including but not limited to vinyl chloride, vinylidene chloride, vinyl bromide, vinylidene bromide, and the like. Commercially available examples of suitable acrylic and modacrylic fibers and fibers that are engineered from acrylonitrile precursors, include PYROTEX, PROTEX, KANEKALON and KANECARON.

The FR fiber preferably has excellent fire retardancy performance combined with non-melt, non-drip and self-extinguishing properties. The FR fiber preferably has a Limit of Oxygen Index (LOI) value from 25 to 50, more preferably from 28 to 47 and even more preferably from 40 to 45. The LOI represents the minimum oxygen concentration of an $O_2/N_2$ mix required to sustain combustion of a material and is determined by ASTM Test D 2862-77.

While the LOI is a good indicator of the flame resistance of a fabric, LOI alone may not be the definitive indicator on how protective a fiber will be. The thermal conductivity of a fiber (K value) determines the ability of a material to conduct heat. Materials having relatively low thermal conductivity act as insulators against the transfer of heat, which is a valuable property for FR fabrics and garments. Thus, FR fibers of the invention preferably have a thermal conductivity value K less than 0.1 BTU in/h-ft$^2$/° F. or from 0.01 to 0.1 BTU in/h-ft$^2$/° F. (i.e., less than 0.014 W/m/K or from 0.00144 to 0.014 W/m/K).

The FR fiber preferably has a relatively high moisture regain percentage so as to provide the resulting fabric and garments thereof with good wearability. The moisture regain is defined as the weight of water in a material expressed as a percentage of the oven-dry weight of the material. The FR fiber preferably has a moisture regain percentage greater than 5% or from 7% to 17% or from 11% to 13%. All moisture regain values referenced herein are at 22° C. and a relative humidity of 65% unless stated otherwise.

Most preferably, the FR fiber is PYROTEX, which has an LOI value of 43, a thermal conductivity of 0.044 BTU in/h-ft$^2$/° F. (0.00635 W/m/K) and a moisture regain of 12%. In addition, PYROTEX has anti-microbial and anti-viral properties and is dyeable.

The durability enhancing (DE) fiber has a tenacity greater than 5 grams/denier, or from 10 to 35 grams/denier or from 20 to 32 grams/denier. The DE fiber is preferably an aramid fiber wherein the fiber-forming substance is a long-chain synthetic polyamide in which at least 85% of the amide linkages are attached directly to two aromatic rings, including, but not limited to, para-aramid and meta-aramid. Suitable examples of para-aramids include but are not limited to (poly(p-phenylene terephthalamide), e.g., KEVLAR, TWARON and TECHNORA.

Suitable meta-aramids include but are not limited to (poly(m-phenylene isophthalamide), such as NOMEX and CONEX. Preferably, the DE fiber is a para-aramid, such as KEVLAR or TWARON, which has excellent thermal stability, is virtually non-flammable and resistant to melting, dripping and burning at a temperature of 371° C.

Suitable DE fibers preferably have an LOI value of at least 25, or from 25 to 33.

Suitable DE fibers preferably have a thermal conductivity less than 0.05 W/m/K, or from 0.005 to 0.05 W/m/K. Preferred DE fibers KEVLAR and TWARON have a thermal conductivity of 0.04 W/m/K.

Suitable DE fibers preferably have a moisture regain value of at least 2%, or 2-10% or 3-5%. Preferred durability enhancing fiber TWARON has a moisture regain value of about 4%.

Yarns, fabrics and garments having high moisture regain potential are preferred to improve the comfort of the wearer of the garments. It is therefore preferred to include a substantial percentage of at least one wearability enhancing (WE) fiber in the yarns of the invention.

Although the WE fibers are primarily included to enhance comfort, it is preferred to use WE fibers that have favorable FR properties or at least have properties that do not substantially undermine the overall FR properties of the yarn, fabric and garment. Thus, suitable WE fibers preferably have an LOI value of at least 17, or from 20 to 30, and preferably have a thermal conductivity less than 0.1 W/m/K, or from 0.02 to 0.05 W/m/K.

Wool is the most preferred WE fiber for use in the invention, but other WE fibers are within the scope of the invention, such as FR Rayon and TENCEL (i.e., lyocell). Wool has a thermal conductivity of about 0.036 W/m/K.

Suitable WE fibers preferably have a moisture regain value of at least 12%, or 12-20% or 14-16%. Wool has a moisture regain value of about 15%.

Yarns of the invention comprise an FR fiber and at least one of a DE fiber and a WE fiber. When electrostatic dissipation is desired, an anti-static (AS) fiber is added to the blend. The relative percentages of staple fibers in the yarns can be varied to adjust the properties of the resulting yarns, fabrics and garments. Preferred ranges of the fibers in the yarns are shown in Table 1 below:

TABLE 1

| Fiber | Range A (wt. %) | Range B (wt. %) | Range C (wt. %) | Range D (wt. %) |
|---|---|---|---|---|
| FR | 30-80 | 33-75 | 49-51 | 47 |
| DE | 0-49 | 10-40 | 29-31 | 29-31 |
| WE | 0-49 | 1-36 | 19-21 | 19-21 |
| AS | 0-5 | 0-5 | 0-5 | 3 |

The yarn, fabric comprising the yarn and garments comprising the fabric are preferably free of thermoplastics so as to avoid damage caused by melting and dripping of fibers exposed to fire and/or high temperatures. The yarn, fabric comprising the yarn and garments comprising the fabric are preferably free of antimony and/or halogen compounds, which might otherwise detract from the environmental friendliness of the inventive materials.

At least some of the fibers of the yarn are preferably hydrophilic or otherwise capable of accepting and retaining dyes.

Yarn design impacts final fabric performance. In a particularly preferred embodiment of the invention, the yarn is a tri-blend of 50% PYROTEX, 30% Para-aramid and 20% Wool. Each of these fibers is inherently FR. The individual percentage ratios were selected to meet specific fabric mechanical characteristic objectives. PYROTEX has the highest LOI and lowest K value of any of the fibers in the blend. It also has high moisture regain value which impacts wearer comfort. PYROTEX is also anti-microbial, with a 98.65% reduction in *Staphylococcus Aureus* after 24 hours of exposure, and is also anti-viral, with a 99.75% reduction rate of SARs2-cov in 14 seconds. PYROTEX is also Oeko-Tex Standard 100, Class 1 certified. This means that while it is an FR fiber, it is benign enough to be used in articles that come in contact with baby skin. The inclusion of the para-aramid in this blend was to increase the fabric strength. The wool was added to help manage the moisture content and wicking characteristics of the fabric, and to add a natural FR fiber to the blend.

Yarns can be constructed from short or long staple fibers. The most economical choice is to use all short staple fibers. However, yarns having high percentages of short staple fibers tends to be weaker with poorer abrasion resistance. Thus, it is preferred to use only long staple fibers in the inventive yarns. Preferably, only fibers having a minimum staple length of 80 mm are included in the yarn. More preferably, fibers of varying lengths from 80 mm to 120 mm are included in the yarn.

The yarns are produced using a spinning process, such as a ring, air jet, open end or "DREF" (DREF out) type spinning frame and spinning process. The finished yarns can be further spun, twisted or wrapped with additional yarns to form composite engineered yarns.

Yarns are preferably manufactured using a long staple spinning process. Staple length for each fiber is predetermined and twist levels are also predetermined. These two variables are controlled to maximize the breaking strength of the yarn and also to minimize the yarns hairiness and mechanical faults.

A short staple length spinning system can achieve the same thermal properties achievable using the long staple spinning system. However, the strength of the fabric will be greatly reduced.

The para-aramid fibers were not square cut but instead were stretch broken. The objective of this operation was to produce the strongest yarn possible with the lowest potential for pilling.

Inventive Fabrics and Garments

The yarn can be formed into any suitable type of fabric including, but not limited to, non-wovens, such as hydroentangled, felts, needle-punched, thermal or point bonded, and wet-laid fabrics, and woven fabrics including, plain weaves, twill weaves, denim weaves, and knits for example. The fabrics may be formed into any suitable type of garment. Any suitable number of yarns may be plied together including, but not limited to, two, three, four, five, more than five and the like.

The weaving process can be done on any type of loom.

Through two separate weaving trials, the resulting break strengths indicate that fiber staple length and processing techniques employed when constructing the warp and weft yarns impact the fabric's strength characteristics. The fabric's break strength can be increased by 50%. The tear strengths could be increased by 30%. These strength improvements can be reached without adding any weight to the current (FRACU out) fabric. It is expected that garments constructed with stronger fabric should have a longer life cycle.

The inventive fabrics are particularly useful in the construction of Infantry FRACUs, tankers ICVCs (Improved Coveralls, Combat Vehicle Crewmen), aviators A2CU and CWU-27P (Aircrew Combat uniforms). The fabric can also be used to construct personal protection garments for first responders, electricians, oil and gas workers, steel, welders and molten metal workers.

FR fabrics are intended to minimize or eliminate the risk of bodily injury from fire, particularly burns. This type of injury can be predicted by conducting a controlled a Pyroman evaluation using the ASTM F1930 test method. As described in the Manikin Burn Injury Test of the Examples section below, when testing the current FRACU pursuant to ASTM F1930, the expected burn rate for a person wearing the fabric exposed to either a three- or four-second flame exposure is that the person will experience burns covering 35% of his/her body. These burns will be both second and third degree burns.

When garments manufactured with a fabric of the invention were subjected to the same test, the anticipated burn rate dropped considerably. After 3 seconds of flame exposure a person wearing the fabric could expect to have 7.1% of his/her body covered with either 2nd or 3rd degree body burns. The expectation for the current FRACU under the same conditions is 35%. With a 4-second exposure to flames, a person wearing the inventive garment could expect to have 12.8% of his/her body covered with either 2nd or 3rd degree body burns. The expectation for the current FRACU under the same conditions is 35%.

While the current FRACU fabric and PPE fabrics are flame resistant, they have a relatively low LOI. Minimizing exposure to flame is critical, but the ability to protect the skin from exposure to high heat is also important. Inclusion in the fabrics and garments of fibers having relative low thermal conductivity helps to insulate the wearer from excessive heat transfer through the garment.

There is approximately 10% by weight of nylon in the current FRACU blend. Nylon is also used in many PPE fabrics. This fiber is added to improve the abrasion resistance of the finished fabric and also to reduce cost. Nylon is also not a Flame Resistant fiber. The melting point of nylon 6,6 is 268.8° C. Molten nylon will cause burns at the point of contact with the skin. The optional exclusion of melt spun fibers (i.e., thermoplastic fibers), such as nylon, from the yarns, fabrics and garments of the invention eliminates the possibility of burns being caused by molten liquid components of the yarns at high temperatures.

Rayon, which is one of the fibers included in current FRACU garments, loses more than 50% of its strength when subjected to moisture. While all fibers may lose some strength when exposed to moisture, the exclusion of cellulosic fibers from the inventive yarns, fabrics and garments will extend the life cycle of FRACUs (FRACU OUT USE GARMENTS) based on the inventive materials.

In certain embodiments, the fabric is constructed in both Plain and Twill weaves. The yarn can optionally include 3% by weight of an electrostatic dissipative fiber. The plain weave is preferably not a ripstop. The twill is preferably a 2×2 twill weave. The yarn for this fabric construction preferably includes 3% by weight of an electrostatic dissipative fiber.

The fabrics are optionally printed (OCP) to meet visual and near-infrared camouflage standards including colorfastness. The fabrics are finished in a fashion that assures dimensional stability. The fabrics can also be piece dyed if a single shade is required.

The invention will be illustrated in more detail with reference to the following Examples, but it should be understood that the present invention is not deemed to be limited thereto.

EXAMPLES

Methodology

Calculations were performed and testing was conducted to evaluate the performance properties of FR fabrics in accordance with the invention relative to conventional fabrics used in military uniforms. The inventive FR fabrics of the Examples comprised intimate blends of PYROTEX, para-aramid and wool.

A conventional FRACU fabric, which comprised an intimate blend of cellulosic FR rayon, para-aramid and nylon (Cloth Flame Resistant GL-PD-07-12, 3 May 2016, Type III, Class III) was compared with an inventive fabric, which was an intimate blend of 50% PYROTEX, 30% TWARON (para-aramid) and 20% wool. An electrostatic dissipative fiber (P140) can be optionally added to the yarn bundle in an amount of about 3% by weight of the yarn mass. The inventive yarn is constructed with all long staple fibers having a length of at least 80 mm. To facilitate ease of processing during yarn construction, tops manufactured of PYROTEX and TWARON are built before final blending with the wool. A roving with a controlled weight ratio of PyroTex and Twaron is constructed. A second roving of a predetermined weight of wool is constructed. These two rovings are then blended and drawn at a predetermined rate to assure accuracy in the final blend distribution.

Properties calculated included the LOI, the thermal conductivity and moisture regain.

Example 1—LOI

The LOI of a fabric is a measurement which indicates the amount of oxygen required for the fabric to support a flame. The lower the LOI, the more combustible the fabric is. LOIs of fabric blends were calculated from the known LOIs of the individual components of the blends. Results of the LOI calculations are shown in Tables 2 and 3 below.

TABLE 2

LOI of Conventional FRACU Fabric

| Fabric Blend Components (wt. %) | LOI | Prorated LOI |
|---|---|---|
| 65% FR Rayon | 28 | 18.2 |
| 25% Para-aramid | 28 | 7.0 |
| 10% Nylon | 24 | 2.4 |
| TOTAL LOI | | 27.6 |

TABLE 3

LOI of Inventive Fabric

| Fabric Blend Components (wt. %) | LOI | Prorated LOI |
|---|---|---|
| 30% Para-aramid | 28 | 8.4 |
| 50% PYROTEX | 43 | 21.5 |
| 20% Wool | 26 | 5.2 |
| TOTAL LOI | | 35.1 |

The calculated LOI of the inventive fabric is 7.5 points or 27.2% higher than the conventional FRACU fabric.

Example 2—Thermal Conductivity

The thermal conductivity of a fiber (K value) determines the ability of a material to conduct heat. The lower the K values the better the protection that material exhibits against heat transfer. K values of fabric blends were calculated from the known K values of the individual components of the blends. Results of the thermal conductivity calculations are shown in Tables 4 and 5 below.

TABLE 4

Thermal Conductivity of Conventional FRACU Fabric

| Fabric Blend Components (wt %) | K (BTU in/h-ft$^2$/° F.) | Prorated K (BTU in/h-ft$^2$/° F.) |
|---|---|---|
| 65% FR Rayon | 0.50 | 0.33 |
| 25% Para-aramid | 0.32 | 0.08 |
| 10% Nylon | 0.25 | 0.03 |
| TOTAL K | | 0.44 |

TABLE 5

Thermal Conductivity of Inventive Fabric

| Fabric Blend Components (wt %) | K (BTU in/h-ft$^2$/° F.) | Prorated K (BTU in/h-ft$^2$/° F.) |
|---|---|---|
| 30% Para-aramid | 0.32 | 0.10 |
| 50% PYROTEX | 0.044 | 0.02 |
| 20% Wool | 0.25 | 0.05 |
| TOTAL K | | 0.17 |

This combination of a high LOI and a low K value of the inventive fabric shows that the inventive fabric has an outstanding ability to protect the wearer from burns that are a result of either exposure to flame or high heat.

Manikin Burn Injury Test

Garments prepared with the inventive fabric were tested using the manikin test of ASTM F1930. The results are shown in Table 6 below.

TABLE 6

| | Flame Exposure (sec) | Second Degree (%) | Third Degree (%) | Overall % | Current Expectation % |
|---|---|---|---|---|---|
| Example 3 | 3 | 0.82 | 6.56 | 7.38 | 35 |
| Example 4 | 3 | 0.00 | 6.56 | 6.56 | 35 |
| Example 5 | 3 | 0.82 | 6.56 | 7.38 | 35 |
| | Average | 0.55 | 6.56 | 7.11 | |
| Example 6 | 4 | 6.56 | 6.56 | 13.11 | 35 |
| Example 7 | 4 | 5.74 | 6.56 | 12.30 | 35 |
| Example 8 | 4 | 6.56 | 6.56 | 13.11 | 35 |
| | Average | 6.28 | 6.56 | 12.84 | |

The results in Table 6 show that fabrics of the invention are a significant improvement over current FRACUs ("Current Expectation"). After 3 seconds of flame exposure a person wearing a garment of the invention could expect to have 7.1% of his/her body covered with either 2nd or 3rd degree body burns. The expectation for the current FRACU under the same conditions is 35%. With a 4-second exposure to flames, a person wearing the inventive garment could expect to have 12.8% of his/her body covered with either 2nd or 3rd degree body burns. The expectation for the current FRACU under the same conditions is 35%.

Example 9—Moisture Regain

In addition to flame resistance, it is desirable for a fabric intended for use in garment manufacture to have good wearability. Most FR garments are uncomfortable to wear because of the high crystallinity of most FR fibers and the resultant lack of moisture regain capability. Moisture Regain (MR) values for blends were calculated from the known MRs of the individual components of the blends at room temperature (22° C.) and a relative humidity of 65%. Results of the MR calculations are shown in Tables 7-8 below.

TABLE 7

MR of Conventional FRACU Fabric

| Fabric Blend Components (wt %) | MR (%) | Prorated MR (%) |
|---|---|---|
| 65% FR Rayon | 11.5 | 7.5 |
| 25% Para-aramid | 4.0 | 1.0 |
| 10% Nylon | 4.2 | 0.42 |
| TOTAL MR (%) | | 8.92 |

TABLE 8

MR of Inventive Fabric

| Fabric Blend Components (wt %) | MR (%) | Prorated MR (%) |
|---|---|---|
| 30% Para-aramid | 4.0 | 1.2 |
| 50% PYROTEX | 12.0 | 6.0 |
| 20% Wool | 15.0 | 3.0 |
| TOTAL MR (%) | | 10.2 |

The calculated Moisture Regain value for the inventive fabric is approximately 14.4 percent higher than the MR value of a conventional FRACU fabric.

While the invention has been described in detail and with reference to specific examples thereof, it will be apparent to one skilled in the art that various changes and modifications can be made therein without departing from the spirit and scope thereof.

What is claimed is:

1. A yarn comprising a blend of:

50 wt. % of a flame resistant fiber having a limit of oxygen index of 43%, a thermal conductivity of 0.0063 watt/meter/K and a moisture regain of 12%;

30 wt. % of a para-aramid fiber; and 20 wt. % of wool, wherein the yarn is free of thermoplastics and is sufficiently flame resistant such that a fabric consisting of the yarn is effective to limit a body burn percentage resulting from 4 seconds of flame exposure to less than 13% as measured by ASTM F1930.

2. The yarn of claim 1, which is free of cellulosic fibers.

3. The yarn of claim 1, further comprising an electrostatic dissipative fiber.

4. A garment comprising the yarn of claim 1, which is effective to limit the body burn percentage resulting from 4 seconds of flame exposure to less than 13% as measured by ASTM F1930.

5. A fabric comprising a blend of:

50 wt. % of a flame resistant fiber having a limit of oxygen index of 43%, a thermal conductivity of 0.0063 watt/meter/K and a moisture regain of 12%;

30 wt. % of a para-aramid fiber; and 20 wt. % of wool, wherein the fabric is free of thermoplastics and is effective to limit a body burn percentage resulting from 4 seconds of flame exposure to less than 13% as measured by ASTM F1930.

6. The fabric of claim 5, which is free of cellulosic fibers.

7. The fabric of claim 5, further comprising an electrostatic dissipative fiber.

8. The fabric of claim 5, which has a limit of oxygen index of 35.1.

9. The yarn of claim 1, which has a limit of oxygen index of 35.1.

* * * * *